US009818501B2

(12) United States Patent
Elie et al.

(10) Patent No.: US 9,818,501 B2
(45) Date of Patent: Nov. 14, 2017

(54) MULTI-COATED ANODIZED WIRE AND METHOD OF MAKING SAME

(71) Applicant: Ford Global Technologies, LLC, Dearborn, MI (US)

(72) Inventors: Larry Dean Elie, Ypsilanti, MI (US); Allan Roy Gale, Livonia, MI (US); John Matthew Ginder, Plymouth, MI (US); Clay Wesley Maranville, Ypsilanti, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 244 days.

(21) Appl. No.: 13/654,655

(22) Filed: Oct. 18, 2012

(65) Prior Publication Data

US 2014/0110145 A1 Apr. 24, 2014

(51) Int. Cl.

| | |
|---|---|
| ***H01B 7/00*** | (2006.01) |
| ***H01B 3/10*** | (2006.01) |
| ***H01B 1/02*** | (2006.01) |
| ***C25D 11/04*** | (2006.01) |
| ***C25D 11/12*** | (2006.01) |
| ***C25D 11/18*** | (2006.01) |

(52) U.S. Cl.

CPC ..... *H01B 3/105* (2013.01); *C25D 11/04* (2013.01); *C25D 11/12* (2013.01); *C25D 11/18* (2013.01); *H01B 1/026* (2013.01); *H01B 7/0009* (2013.01)

(58) Field of Classification Search

CPC .. C23C 2/02; C23C 2/28; C23C 26/02; C25D 11/12; C25D 11/18; C25D 11/04; H01B 7/0009; H01B 3/105; H01B 1/026

USPC ..... 174/126.2

See application file for complete search history.

(56) References Cited

U.S. PATENT DOCUMENTS

| | | | | |
|---|---|---|---|---|
| 3,428,925 | A * | 2/1969 | Bogner | C25D 3/42 174/110 R |
| 3,935,402 | A | 1/1976 | Gersten | |
| 4,014,758 | A | 3/1977 | Kawai et al. | |
| 4,985,313 | A * | 1/1991 | Penneck | C23C 28/00 428/627 |
| 5,091,609 | A * | 2/1992 | Sawada | C23C 18/1216 174/110 A |
| 5,192,610 | A * | 3/1993 | Lorimer | C23C 8/34 428/336 |
| 5,277,788 | A | 1/1994 | Nitowski et al. | |
| 5,486,283 | A | 1/1996 | Mnich | |
| 5,693,208 | A | 12/1997 | Paulet | |
| 6,261,437 | B1 | 7/2001 | Hernnaes et al. | |
| 6,565,984 | B1 * | 5/2003 | Wu | C23C 16/4401 205/324 |
| 7,166,205 | B2 | 1/2007 | Kuo et al. | |

(Continued)

*Primary Examiner* — Pete Lee

(74) *Attorney, Agent, or Firm* — LeClairRyan

(57) ABSTRACT

An insulated electric conductor having a copper core, a layer of aluminum formed on the copper core, and a second layer of aluminum in the form of high-purity aluminum is disclosed. The copper core may be a solid core or may be formed from a plurality of copper strands. The layer of aluminum formed over the copper core is at least partially anodized to form an aluminum oxide dielectric layer. The layer of high-purity aluminum may be formed by evaporation deposition, sputter deposition, or co-extrusion. Once the layer of high-purity aluminum is formed, it is anodized. More than two layers of aluminum may be formed over the copper core.

6 Claims, 4 Drawing Sheets

(56) References Cited

U.S. PATENT DOCUMENTS

| | | | | |
|---|---|---|---|---|
| 7,404,887 | B2 | 7/2008 | Katsir et al. | |
| 2006/0024517 | A1* | 2/2006 | Doan | C23C 16/0227 428/469 |
| 2008/0179074 | A1* | 7/2008 | Elie et al. | 174/110 R |
| 2008/0274375 | A1* | 11/2008 | Ng | C25D 11/08 428/687 |
| 2012/0163758 | A1* | 6/2012 | McCullough | H01B 7/14 385/101 |

* cited by examiner

MULTI-COATED ANODIZED WIRE AND METHOD OF MAKING SAME

TECHNICAL FIELD

The disclosed invention relates generally to an anodized conductor and method of making the anodized conductor. More particularly, the disclosed invention relates to a composite conductor having a copper core and an anodized aluminum dielectric layer overcoated with a second anodized aluminum layer and method for making same through post-metallic coating.

BACKGROUND OF THE INVENTION

The insulation of electrically conductive wire used to form a coil or similar conductive article is generally established and may be undertaken by a number of methods, including the fundamental approaches of coating with an organic polymerized material or anodization. With respect to the first approach, any one of several organic wire coatings selected from the group consisting of plastics, rubbers and elastomers will provide effective insulation on conductive material. However, while these materials demonstrate good dielectric properties and have the ability to withstand high voltages, they are compromised by their poor operating performance at temperatures above 220° C. as well as by their failure to effectively dissipate ohmic or resistance heating when used in coil windings. (Inorganic insulation such as glass, mica or certain ceramics, tolerates temperatures greater than 220° C. but suffers from being too brittle for most applications.)

In addition to coating conductive material with an organic substance, electrically conductive materials such as copper and aluminum may be anodized to provide some measure of insulation. In the case of a copper core, the anodization of this material is known to produce unsatisfactory results due to cracking. It is possible to electroplate copper with aluminum but this approach generally produces undesirable results in terms of durability of the coating. In the case of an aluminum core, copper can be plated on the core but results in unsatisfactory electrical efficiency.

An electrically insulated conductor for carrying signals or current having a solid or stranded copper core of various geometries with only a single electrically insulating and thermally conductive layer of anodized aluminum (aluminum oxide) is disclosed in U.S. Pat. No. 7,572,980. As described in the '980 patent, the device is made by forming uniform thickness thin sheet or foil of aluminum to envelop the copper conductive alloy core. The aluminum has its outer surface partially anodized either before or after forming to the core in an electrolytic process to form a single layer of aluminum oxide.

This and other examples of the known art represent improvements in the coating of wire and other forms of electrical transmission. However, as in so many areas of technology, there is room in the art of wire coating for further advancement.

SUMMARY OF THE INVENTION

The disclosed invention advances electric conductor technology and overcomes several of the disadvantages known in the prior art. Particularly, the disclosed invention provides an insulated electrical composite conductor having a copper core, a layer of aluminum formed on the copper core, and a second layer of aluminum in the form of high-purity aluminum. The copper core may be a solid core or may be formed from a plurality of copper strands.

The layer of aluminum formed over the copper core is at least partially anodized to form an aluminum oxide dielectric layer. The layer of high-purity aluminum may be formed by evaporation deposition, sputter deposition, or co-extrusion. Once the layer of high-purity aluminum is formed, it is anodized. More than two layers of aluminum may be formed over the copper core.

The electric conductor of the disclosed invention may be useful in a broad variety of applications where coiled wire or similar conductive material is required, such as for vehicle generators, alternators and for subsystems related to generators, alternators and regulators. Accordingly, the disclosed invention may be useful in the manufacture of both internal combustion vehicles as well in hybrid vehicles and systems for hybrid vehicles. Furthermore, the disclosed invention may find application in any electrical motor that requires very high voltage, effective heat dissipation and high temperature operation. Accordingly, the disclosed invention may find application in the locomotive and aerospace industries as well as in the automotive vehicle industry.

The above advantages and other advantages and features will be readily apparent from the following detailed description of the preferred embodiments when taken in connection with the accompanying drawings.

BRIEF DESCRIPTION OF THE DRAWINGS

For a more complete understanding of this invention, reference should now be made to the embodiments illustrated in greater detail in the accompanying drawings and described below by way of examples of the invention wherein.

DETAILED DESCRIPTION OF THE PREFERRED EMBODIMENT

Figure 1A:
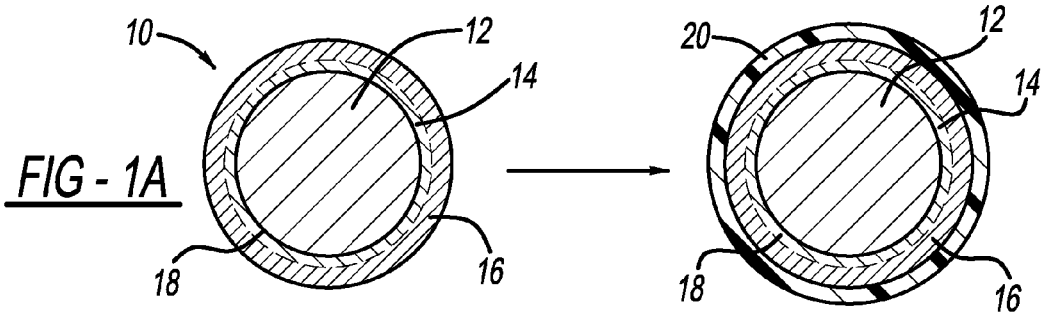
FIGS. 1A-1D are sectional views of wires and related electrical conductors illustrated before and after being overcoated with a thin layer of high-purity aluminum according to the disclosed invention.

In the following figures, the same reference numerals will be used to refer to the same components. In the following description, various operating parameters and components are described for different constructed embodiments. These specific parameters and components are included as examples and are not meant to be limiting.

With respect to FIGS. 1A-1D, sectional views of wires and related electrical composite conductors illustrated before and after being overcoated with a thin layer of high-purity aluminum according to the disclosed invention are illustrated. The wires and related conductors are preferably although not necessarily formed according to the methods and materials set forth in U.S. Pat. No. 7,572,980 incorporated by reference in its entirety herein. The '980 patent is assigned to the same assignee to which the disclosed invention is assigned.

With particular reference to FIG. 1A, a sectional view of a composite conductor, generally illustrated as 10, is shown. The composite conductor 10 includes a copper or copper alloy core 12 and an aluminum layer 14. As set forth in the '980 patent, the aluminum layer 14 is formed by enveloping the copper core 12 with a uniform thickness thin sheet of aluminum and partially anodizing the outer surface of the sheet to form a dielectric layer 16 of aluminum oxide. The dielectric layer 16 electrically insulates the copper core 12 while being thermally conductive to dissipate heat generated due to normal operations. A thin layer 18 of electrically conductive aluminum surrounds the core 12 and facilitates adhesion or bonding of dielectric layer 16 to the core 12.

According to the disclosed invention, the composite conductor 10 may be further insulated to achieve a high uniform electrical breakdown and thus expand the utility of electrically conductive composite wire beyond the range previously known. This is achieved by adding a layer of high-purity aluminum. The high-purity aluminum is the result of the refining of aluminum to remove impurities resulting in purity of at least 99.99%. The layer of high-purity aluminum, illustrated as 20 in FIG. 1A, may be formed by a number of methods described below.

Figure 1B:
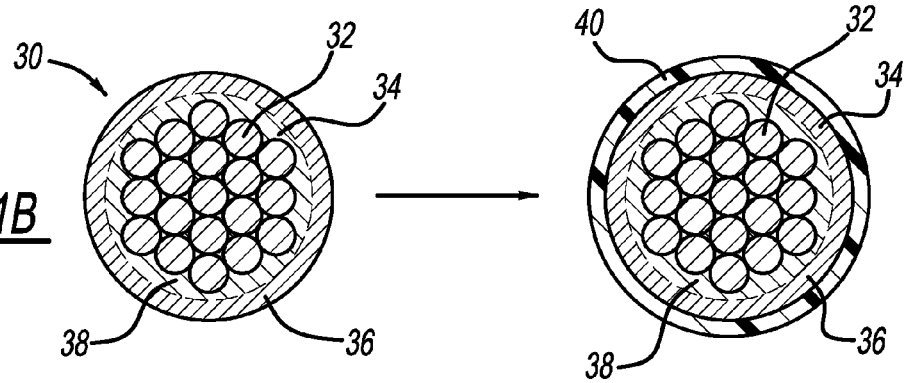

Referring to FIG. 1B, a sectional view of an alternate embodiment of the composite conductor according to the disclosed invention, is generally illustrated as 30, is shown. The composite conductor 30 includes a copper or copper alloy core 32 formed from a plurality of independent copper or copper alloy strands. The composite conductor 30 further includes an aluminum layer 34, the outer surface of which has been anodized according to the method of the '980 patent to form dielectric layer 36 of aluminum oxide. A thin layer 38 of electrically conductive aluminum surrounds the core 32. The composite conductor 30 has a layer of high-purity aluminum 40 formed thereover.

Figure 1C:
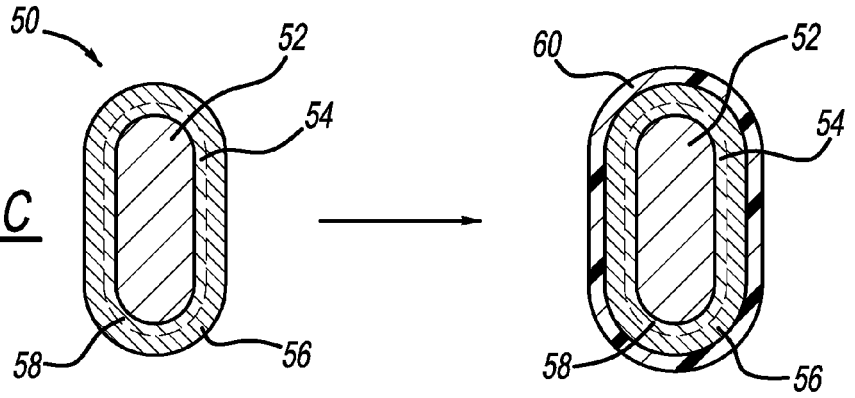
Figure 1D:
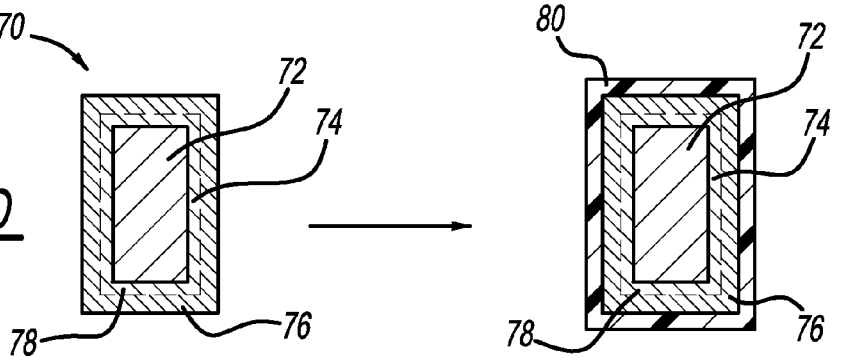

FIGS. 1C and 1D illustrate variations in the shape of the composite conductor according to the disclosed invention. With reference first to FIG. 1C, a sectional view of a composite conductor is generally illustrated as 50. The composite conductor 50 includes a generally flat copper or copper alloy core 52. The composite conductor 50 further includes an aluminum layer 54, the outer surface of which has been anodized to form dielectric layer 56 of aluminum oxide. A thin layer 58 of electrically conductive aluminum surrounds the core 52. The composite conductor 50 has a layer of high-purity aluminum 60 formed thereover.

With reference to FIG. 1D, a sectional view of an additional variation of the composite conductor of the disclosed invention is generally illustrated as 70. The composite conductor 70 includes a generally rectangular copper or copper alloy core 72. The composite conductor 70 includes an aluminum layer 74, the outer surface of which has been anodized to form dielectric layer 76 of aluminum oxide. A thin layer 78 of electrically conductive aluminum surrounds the core 72. The composite conductor 70 has a layer of high-purity aluminum 80 formed thereover.

Figure 2:
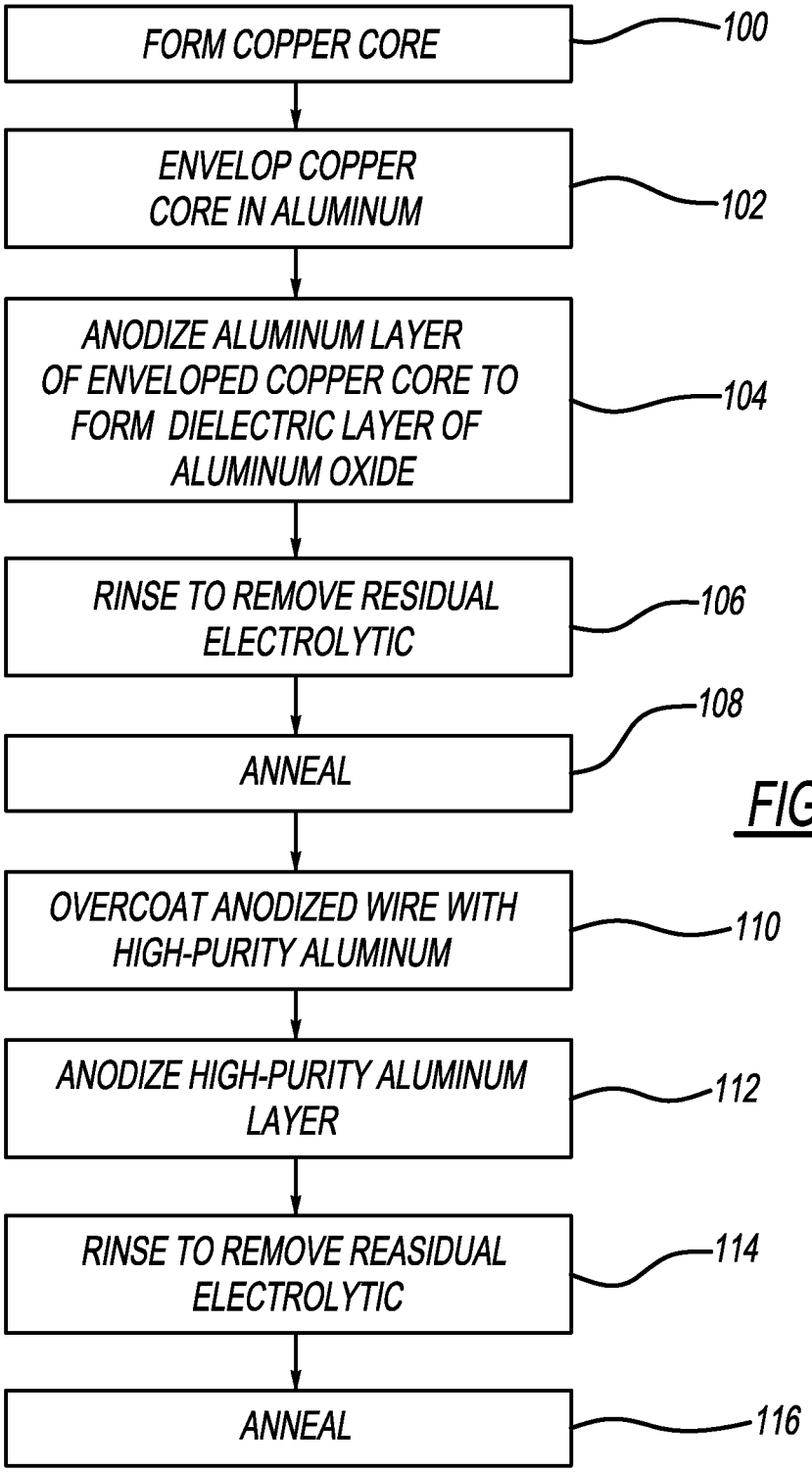
FIG. 2 is a flow chart illustrating a first method for overcoating the anodized wire with a thin layer of high-purity aluminum according to the disclosed invention.

Regardless of the structure of the copper or copper alloy core or the shape, the high-purity aluminum coating of the composite conductor of the disclosed invention may be formed by alternative techniques. FIG. 2 sets forth a flow chart according to one of the preferred methods of forming the high-purity coating on the composite conductor according to the disclosed invention.

Referring to FIG. 2, at a first step 100 the copper core is formed. As set forth above with respect to FIGS. 1A-1D, the copper core may be solid or may be composed of multiple strands. Furthermore the copper core may be copper or copper alloy. Once the copper core is formed, the copper core is enveloped in a thin sheet or foil of aluminum at step 102. Particularly, and as set forth in the '980 patent, at step 102 the copper core (12, 32, 52, 72) is enveloped in a thin sheet of aluminum (14, 34, 54, 74). One or more thin sheets may be used depending on desired core geometry or other parameters. The aluminum sheet may be applied by any technique including but not limited to mechanical cold-forming techniques, co-extrusion techniques, vacuum welding, or RF bonding or any combination thereof.

Once the aluminum layer envelops the copper core at step 102 the outer surface of the aluminum is partially anodized at step 104. This is done using an electrolytic process to form a single homogeneous dielectric layer. It is preferred though not required that the outer layer is only partially anodized thus leaving a thin layer of aluminum in contact with the copper core. In addition, the step of anodizing the aluminum may be undertaken before being applied to the copper core.

At step 106 the anodized aluminum may be rinsed according to an optional step of the disclosed invention. Rinsing of the anodized aluminum stops the anodization process by removing the electrolytic solution.

A further optional step arises at step 108 in which the conductor, now a composite, is annealed. The annealing process reduces or eliminates stresses that may be present in the core, the aluminum layer, the dielectric aluminum oxide layer, or between layers.

Once the aluminum layer has been anodized and optionally rinsed and annealed an overcoating of high-purity aluminum is made at step 110. As will be set forth below, the overcoating of high-purity aluminum may be done by any of several ways, including but not limited to co-extrusion, vacuum evaporation and sputter deposition.

The layer of high-purity aluminum, once applied by any method, is anodized at step 112. At step 114 the anodized composite conductor is again optionally rinsed to remove any residual electrolytic fluid and to thus fully halt the anodization process. At step 116 the rinsed conductor is optionally again annealed.

Figure 3:
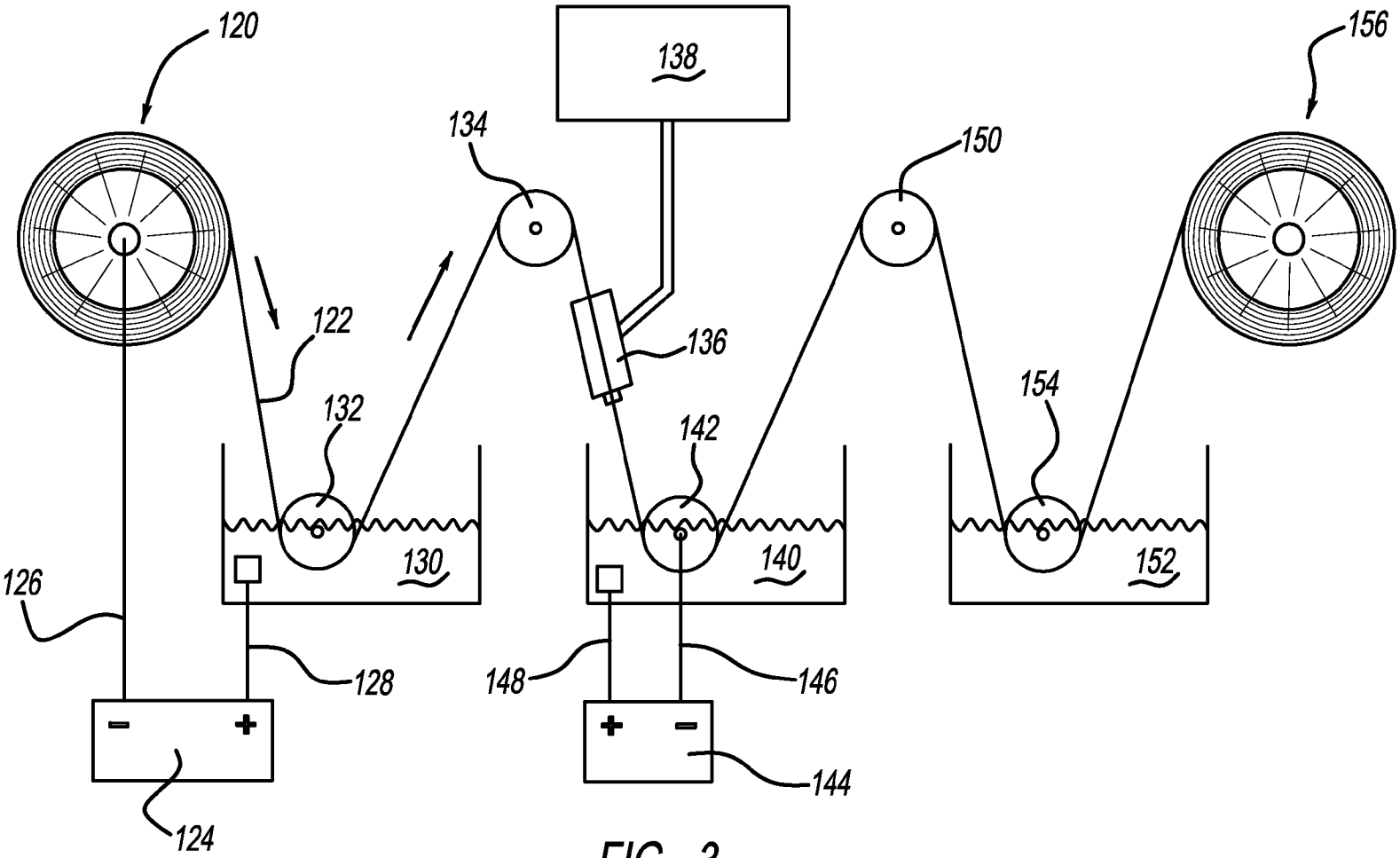
FIG. 3 is a graphical representation of a continuous process for overcoating the anodized layer by co-extruding a new aluminum layer over the first anodized layer and re-anodizing the new aluminum layer according to the second embodiment of the disclosed invention.
Figure 4:
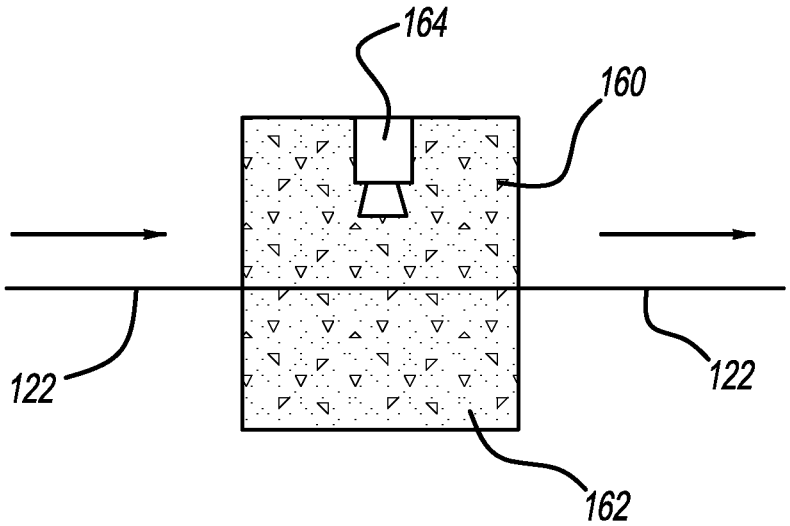
FIG. 4 is a partial graphical representation of part of a continuous process for overcoating the anodized wire with a thin layer of high-purity aluminum through vacuum evaporation according to one variation of the first method of the disclosed invention.
Figure 5:
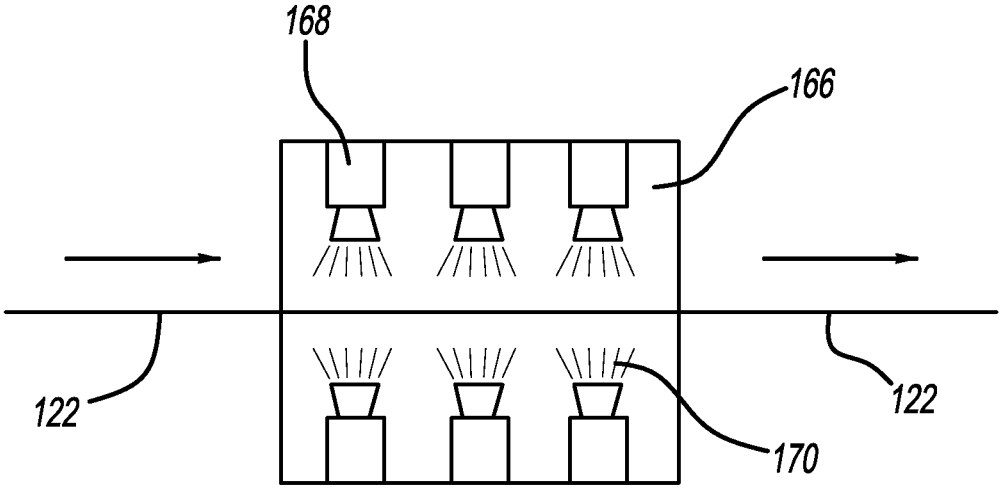
FIG. 5 is a graphical representation of part of a continuous process for overcoating the anodized wire with a thin layer of high-purity aluminum through sputter deposition according to a second variation of the method of the disclosed invention.

As noted, at 110 the composite conductor is overcoated with a layer of high-purity aluminum. The overcoating step may be accomplished through several methods although three methods—co-extrusion, vacuum evaporation and sputter deposition—are preferred. FIGS. 3, 4, and 5 illustrate each of these methods respectively.

Referring to FIG. 3, a graphical representation of a continuous process for overcoating the anodized layer by co-extruding a new aluminum layer over the first anodized layer and re-anodizing the new aluminum layer is illustrated. A supply or feed roll 120 having a continuous length of wire 122 is provided. The wire 122 has a copper or copper alloy core (12, 32, 52, 72) enveloped by a uniform thickness sheet of aluminum (14, 34, 54, 74). A power supply 124 has a negative terminal 126 connected to either the roll 120 or the wire 122. The positive terminal 128 of the power supply 124 is connected to the electrolyte solution 130. The electrolyte solution 130 provides a bath for the wire 122.

At least partially submerged in the electrolyte solution 130 is a guide roller 132. The guide roller 132 guides the wire 122 into and out of the solution 130. The voltage across the terminals 126 and 128 causes an electric current to run through the solution 130, thereby effecting a chemical reaction of the solution 130 with the outer surface of the aluminum. The reaction results in the formation of a dielectric layer of aluminum oxide.

Another guide roller 134 is provided to guide the anodized wire 122 out of the solution 130. At this point the wire 122 may optionally pass through a rinse (not shown) followed by the step of being optionally annealed (also not shown).

An overcoating unit 136 is provided to apply the layer of high-purity aluminum to the anodized wire 122. According to the embodiment shown in FIG. 3, the overcoating unit 136 is a co-extruder that co-extrudes a regulated amount of high-purity aluminum onto the anodized wire 122. The high-purity aluminum is delivered to the overcoating unit 136 from a reservoir 138. The flow rate of high-purity aluminum may be regulated to control layering thickness as is known in the art.

Once overcoated with high-purity aluminum, the overcoated and anodized wire 122 is directed to a second electrolyte solution 140. A guide roller 142 guides the wire into and out of the electrolyte solution 140. A power supply 144 has a negative terminal 146 connected to the wire 122 and a positive terminal 148 connected to the electrolyte solution 140. The electrolyte solution 140 provides a bath for the wire 122. The voltage across the terminals 146 and 148 causes an electric current to run through the solution 140, thereby effecting a chemical reaction of the solution 140 with the outer surface of the high-purity aluminum. The reaction results in the formation of a second dielectric layer of aluminum oxide.

The overcoated wire 122 is guided out of the solution 140 by a guide roller 150. Optionally the wire 122 may be rinsed in a bath 152 to remove any residual electrolyte solution after being guided into and out of the bath 152 by a guide roller 154. The rinsed wire 122 is taken up on a reel 156.

As noted, according to the disclosed invention the high-purity aluminum coating may be overcoated on the wire 122 by other methods. Of no particular order the second of these methods is illustrated in FIG. 4 which illustrates only the high-purity aluminum coating step of the method shown in FIG. 3 and discussed with respect thereto. The other steps illustrated in FIG. 3 and discussed in relation to that figure before and after the overcoating step, both optional and mandatory, are to equally applicable to the overcoating method of FIG. 4 which illustrates the wire 122 passing through a vacuum evaporation chamber 160. High-purity aluminum 162, in evaporated form as is known in the art, is emitted by an evaporator 164 and is deposited onto the wire 122 before it departs the chamber 160. The layer of high-purity aluminum is thereafter anodized as set forth above with respect to FIG. 3.

FIG. 5 illustrates an additional method for overcoating the wire 122 with high-purity aluminum by sputter deposition, a form of physical vapor deposition that is itself known in the art. The wire 122 passes through a sputter deposition chamber 166 where a source or target of high-purity aluminum 168 deposits the thin film of sputtered high-purity aluminum ions 170 onto the wire 122 which acts as a substrate. The overcoated wire 122 then exits the chamber 166.

The foregoing discussion discloses and describes exemplary embodiments of the present invention. One skilled in the art will readily recognize from such discussion, and from the accompanying drawings and claims that various changes, modifications and variations can be made therein without departing from the true spirit and fair scope of the invention as defined by the following claims.

What is claimed is:

1. An insulated electrically conductive wire comprising:
a solid copper core that is circular in cross-section;
a layer of aluminum disposed on said copper core, said layer having an outer surface, said outer surface defining an aluminum oxide dielectric electrically insulating layer; and
an outer layer of anodized aluminum formed from an aluminum layer with a purity of at least 99.99% formed over said aluminum oxide dielectric layer, said layer of aluminum disposed on said copper core, said aluminum oxide dielectric electrically insulating layer, and said outer layer being concentric with said core.

2. The insulated electrically conductive wire of claim 1 wherein more than two layers of aluminum are formed over said copper core.

3. An insulated electrically conductive wire comprising:
a solid copper core that is circular in cross-section;
a layer of aluminum disposed on said copper core, said layer having an outer surface, said outer surface defining an aluminum oxide dielectric electrically insulating layer; and
an outer layer of aluminum formed from an aluminum layer with a purity of at least 99.99% formed over said aluminum oxide dielectric layer, said layer of aluminum disposed on said copper core, said aluminum oxide dielectric electrically insulating layer, and said outer layer being concentric with said core.

4. The insulated electrically conductive wire of claim 3 wherein the layer of aluminum has having a plurality of at least 99.99% is an anodized layer.

5. The insulated electrically conductive wire of claim 3 wherein more than two layers of aluminum are formed over said copper core.

6. An insulated electrically conductive wire comprising:
a solid core that is circular in cross-section;
a first layer of aluminum disposed on said core;
a second layer of aluminum formed on said first layer;
a third layer of aluminum formed on said second layer, said third layer having an outer surface, said outer surface defining an aluminum oxide dielectric electrically insulating layer; and
an outer layer of anodized aluminum formed from an aluminum layer with a purity of at least 99.99% over said aluminum oxide dielectric layer, said first layer, said second layer, said third layer, said aluminum oxide dielectric electrically insulating layer, and said outer layer being concentric with said core.

* * * * *